United States Patent [19]

Hunt

[11] Patent Number: 4,772,030

[45] Date of Patent: Sep. 20, 1988

[54] BOOMERANG

[75] Inventor: J. Turner Hunt, Kirkwood, Mo.

[73] Assignee: Turner Toys Corporation, Kansas City, Mo.

[21] Appl. No.: 128,036

[22] Filed: Dec. 3, 1987

[51] Int. Cl.[4] ..... A63B 65/08

[52] U.S. Cl. ..... 273/426; D21/85

[58] Field of Search ..... 273/426, 425; D21/48, D21/85, 203; D22/115

[56] References Cited

U.S. PATENT DOCUMENTS

| | | | |
|---|---|---|---|
| 692,608 | 2/1902 | Bristow | 273/426 |
| 2,816,764 | 12/1957 | Gleason | 273/426 |
| 3,403,910 | 10/1968 | Claycomb | 273/426 |
| 3,881,729 | 5/1975 | Block et al. | 273/426 |
| 3,955,817 | 5/1976 | Davis | 273/426 |
| 4,479,655 | 10/1984 | Adler | 273/426 X |
| 4,506,894 | 3/1985 | Laux et al. | 273/426 X |
| 4,591,164 | 5/1986 | Blight | 273/426 X |

FOREIGN PATENT DOCUMENTS

| | | | |
|---|---|---|---|
| 2354079 | 5/1975 | Fed. Rep. of Germany | 273/426 |

*Primary Examiner*—Paul E. Shapiro

*Attorney, Agent, or Firm*—Senniger, Powers, Leavitt and Roedel

[57] ABSTRACT

A boomerang comprising a central hub having a generally central aperture therein, a plurality of equally spaced, cambered blades extending generally radially outwardly from the hub, a tip depending generally downwardly from each of the blades but one, the included angle between each blade and its respective tip being greater than 90°, and a weight on the blade without a tip so that the boomerang is mass balanced about an axis through the center of the hub. The included angle between each successive tip and its respective blade may increase in either the clockwise or counterclockwise direction around the boomerang.

18 Claims, 2 Drawing Sheets

BOOMERANG

BACKGROUND OF THE INVENTION

This invention relates to boomerangs, and in particular to boomerangs of the type comprising a central hub with a plurality of radial blades.

Boomerangs have long fascinated man with their tendency to return to the location from where they were thrown. A number of different shapes and constructions have evolved from attempts to improve the performance of boomerangs. One such type of boomerang comprises a central hub with a plurality of radially extending blades or wings. Examples of this type of boomerang are shown in Gleason, U.S. Pat. Nos. 2,816,764, Claycomb, 3,403,910, Liston, 3,565,434, Callahan, 3,814,431, Block, 3,881,729, Flemming, 4,216,962, Bradford, 4,284,278, Martin, 4,307,535, Robson, 4,421,320, Adler, 4,479,655 and U.S. Pat. No. Des. 285,461, and Larson, U.S. Pat. No. Des. 287,517. It is to this type of boomerang that the present invention generally relates.

Despite their reputation, in actual operation the performance of the prior art boomerangs was often disappointing. A great deal of skill and practice was typically required to successfully operate a boomerang. Even with expert operation the prior art boomerangs do not return as well as desired and their flight characteristics make them difficult to see and to catch.

SUMMARY OF THE INVENTION

It is among the objects of the present invention to provide a boomerang of the type comprising a central hub and a plurality of radial blades that is relatively easy to learn to throw and catch; to provide such a boomerang that more reliably returns to the location from which it was thrown; to provide such a boomerang that has improved flight characteristics that makes it easier to see and to catch.

Generally, the boomerang of the present invention comprises a central hub and a plurality of blades extending generally radially outwardly from the hub. A tip depends generally downwardly from the remote end of each of the blades but one.

The width of each tip preferably tapers from the end of the blade toward the end of the tip. The included angle between each tip and its respective blade is preferably greater than 90°, and the included angle between each successive tip and its respective blade increases in either the clockwise or counterclockwise direction around the boomerang. The blades are preferably equally spaced. The blades may be cambered, and preferably are symmetric in transverse cross section about the longitudinal axis of the blade. The tipless blade is preferably weighted to maintain rotational balance. The dihedral angle between the top of the hub and the top of each wing is between about 160° and about 180°.

In operation the boomerang is thrown either upside down in a horizontal plane, or on edge in a vertical plane. On its outward bound ascent path the boomerang flips over until it is right side up (with the tips pointing towards the ground). The tips and the camber of the blade facilitate this flipping action. The boomerang continues to climb until the angle of attack of each blade reaches its maximum lift point and each blade stalls. The boomerang then descends following a downward arcing flight path to the thrower, in a generally blades-level attitude. The tipless blade facilitates the climbing action, causing the boomerang to climb to higher altitudes than the prior art devices, thereby giving the boomerang greater potential energy for its return. This increased climbing action also reduces the outbound range of the boomerang, facilitating a more accurate return to the thrower. Because of the improved flight characteristics of the boomerang, it is easier to learn to throw, and it is easier to see and judge the relative motion of the boomerang. Furthermore, upon the return of the boomerang, its translational velocity is near zero as it enters a hovering mode above the thrower, making it easier to catch than prior boomerangs. The hovering mode is facilitated by the camber of the blades.

These and other features will be in part apparent and in part pointed out hereinafter.

BRIEF DESCRIPTION OF THE DRAWINGS

Corresponding reference numerals indicate corresponding parts throughout the several figures of the drawings.

DETAILED DESCRIPTION OF THE PREFERRED EMBODIMENT

Figure 1:
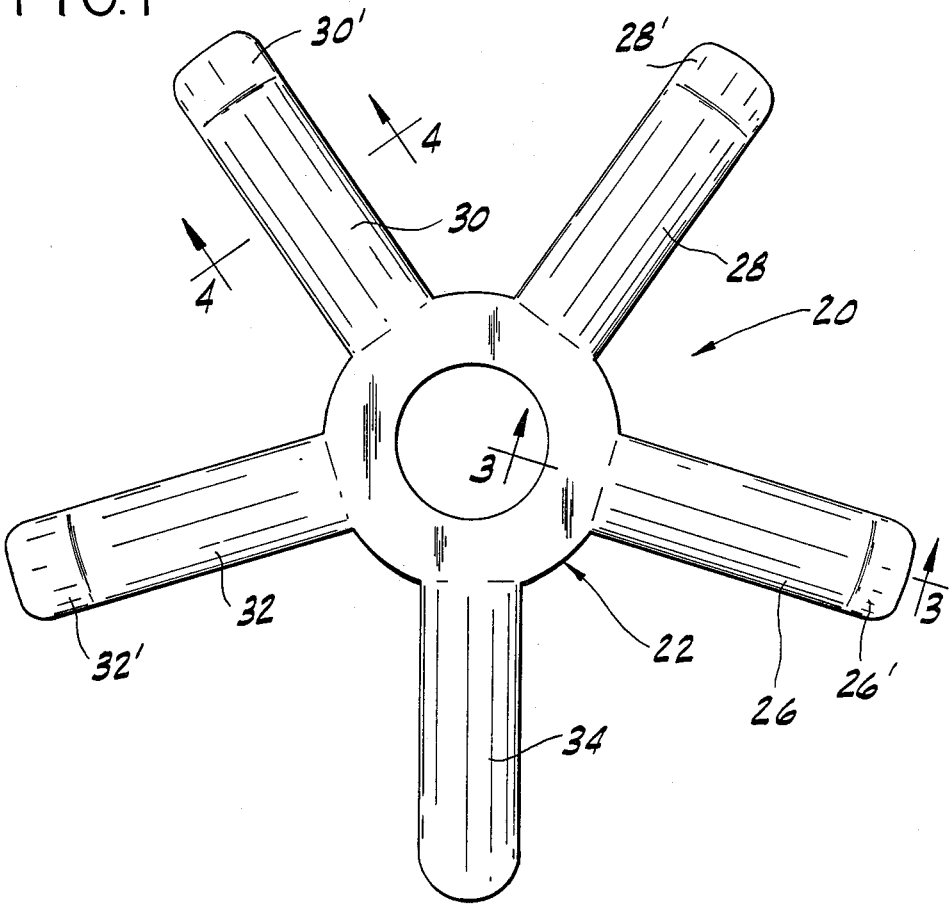
FIG. 1 is a top plan view of the boomerang.
Figure 2:
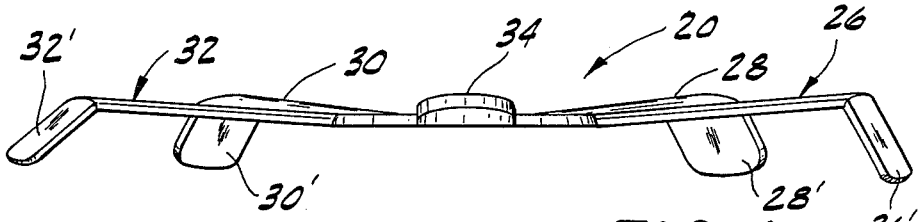
FIG. 2 is a side elevation view of a boomerang constructed according to the principles of this invention.
Figure 5:
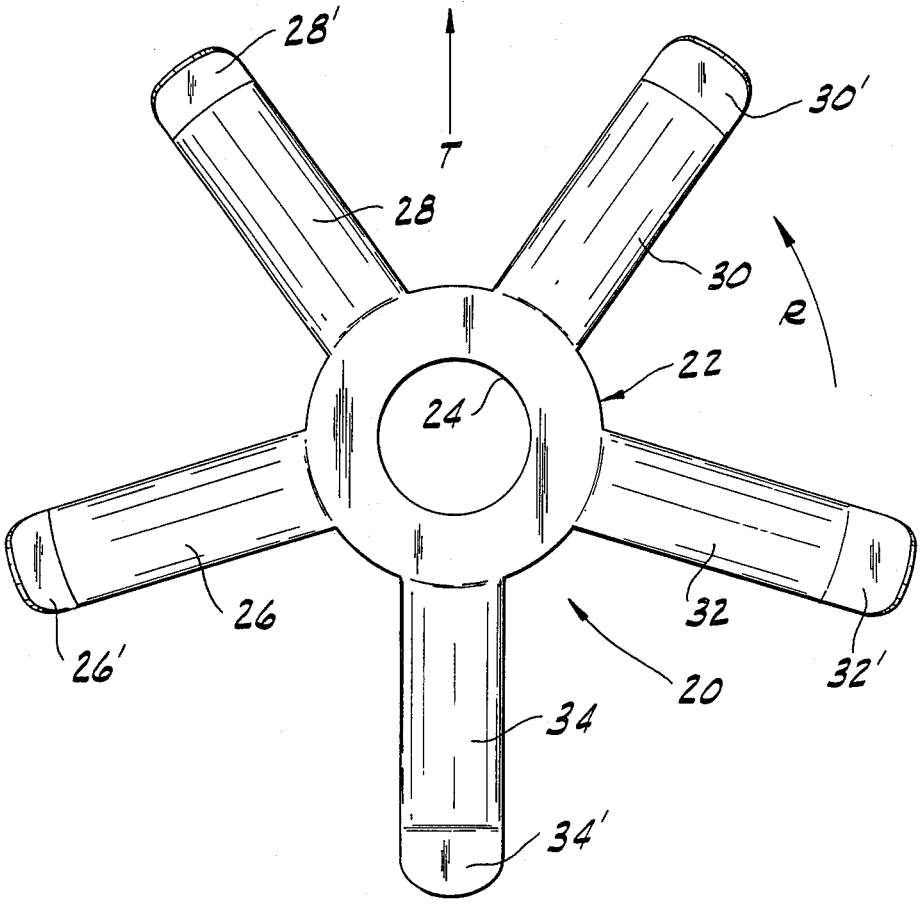
FIG. 5 is a bottom plan view of the boomerang.

A boomerang constructed according to the principles of this invention is indicated generally as 20 in FIGS. 1, 2, and 5. The boomerang 20 is adapted to be thrown flat in a generally horizontal plane or on edge in a generally vertical plane. After it is thrown, the boomerang 20 flips until it is right side up, and climbs until it stalls. The boomerang then returns, remaining right side up as it returns and hovers, giving the user time to position and catch it.

The boomerang 20 comprises a hub 22 having a generally centrally located hole 24 therein. The hole 24 reduces the weight of the boomerang, and provides a convenient way to catch the boomerang, allowing the user to spear the hole 24 in the hovering boomerang with a finger or a stick. The hole 24 also allows air to pass through the boomerang, reducing the lift contributed by the hub 22, and damping the flipping action of the boomerang.

The boomerang 20 further comprises a plurality of blades extending generally radially outwardly from the hub 22. The boomerang should have at least three blades, and in this preferred embodiment the boomerang 20 has five blades 26, 28, 30, 32, and 34 equally spaced from each other. A tip depends generally downwardly from each of the blades but one. Thus blades 26, 28, 30 and 32 have tips 26', 28', 30', and 32', and blade 34 is tipless. The tips retard air from curling over the ends of the blades in a vortical fashion. The tips also decrease the downwash from the blades, limiting pitch up of the boomerang 20.

As the boomerang rotates about its central axis and traverses the flight path, the relative higher velocity air experienced by the blades advancing into the direction of flight in conjunction with the lifting force generated by the tip sections of the advancing blades create a net rolling moment about the longitudinal line of travel. This net rolling moment causes the boomerang to rotate about the longitudinal line of travel and flip over. For the right handed thrower, the blades on the right half of the boomerang (when viewed from above) are advancing into the direction of flight and the blades on the left half are retreating from the direction of flight. The retreating blades and tips on the left half experience a lower relative velocity air stream and thus less lift than the advancing blades and tips on the right side, adding to the net rolling moment about the longitudinal line of flight and facilitating the flipping action.

The tips have rounded edges and their width tapers from the end of the blade to the end of the tip. This taper achieves a loading more closely approximating the optimum elliptical load distribution, thereby minimizing drag due to lift on the tips. The included angle between each tip and its respective blade is preferably greater than about 90° and less than about 160°. The included angle between each successive blade and its respective tip preferably increases in either the clockwise or counter clockwise direction. The angles preferably increase in regular increments of about 5°. Thus, the included angle between blade 26 and its tip 26' may be 120°, between blade 28 and its tip 28' may be 125°, between blade 30 and its tip 30' may be 130°, and between blade 28 and its tip 28' may be 135°.

The smaller the included angle between the blades and the tips, the greater the lift and the faster the boomerang 20 will flip. Thus the flipping action can be controlled to a certain extent by the selection of the included angles between the blades and tips. The greater the rotational moment of inertia of the boomerang due to its mass distribution, the smaller the included angle should be to provide more rolling moment to overcome the inertia, conversely the smaller the rotational moment of inertia, the greater the included angle should be because less force is needed to overcome the inertia. Thus for a boomerang with a relatively high moment of inertia, angles of 120°, 125°, 130°, and 135° might be used, while for a boomerang with a relatively low moment of inertia, angles of 140°, 145°, 150°, and 155° might be used. It has been demonstrated that the flight characteristics of the boomerang are improved with progressively increasing included angles between the blades and their respective tips.

In general, the inventor believes that the quotient between the product of the principle moment of inertia of the boomerang about the central hub axis (I) with the acceleration of gravity (g) divided by the product of the total projected vertical planform area of the tip sections (S) with the radial distance of the center of these tip sections from the central hub axis (r) should not exceed a value of 1.0 ounces per inch. Mathematically speaking:

$$(Ig/rs) \leqq 1.0 \text{ oz./in.}$$

This parameter can be viewed as the ratio between the inertial and aerodynamic forces acting on the device during the outbound flipping motion. The numerator provides a measure of the mass distribution of the device, but more importantly, a measure of the virtual gyroscopic moments acting on the boomerang due to its rotational velocity. The denominator represents the tip section area moment and hence the magnitude of the applied aeordynamic rolling moment imparted to the device to overcome the gyroscopic moments in order to successfully execute the outbound flipping motion. Although not essential to construction of a boomerang according to this invention, by satisfying the above equational relationship, the boomerang can be made to perform by the average thrower without exceptionally strong throws and high release velocities. If the aforementioned ratio exceeds the value of 1.0 by an appreciable degree, the boomerang (20) will exhibit a slow flipping motion on the outbound ascent path, thereby prolonging the outbound journey and possibly preventing the boomerang from completely inverting (with tips pointing towards the ground). This would not only cause an errant return path, but also a return that falls far short of the thrower.

Figure 3:
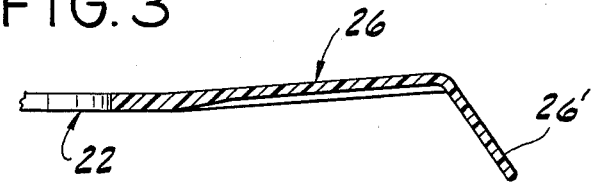
FIG. 3 is a longitudinal cross-sectional view of one of the blades, taken along the plane of line 3—3 in FIG. 1.

Various methods can be employed to selectively control and modulate the three interdependent variables (I, r, and S) to the degree required to provide desirable performance from the device. As best shown in FIG. 3, the preferred embodiment of the invention has a central hub thickness twice that of the blade thickness, and the tip section thickness equivalent to the blade thickness. The blade and tip section thickness can be varied to adjust the weight per unit running length, and hence the moment of inertia of the device about the central hub axis (I) without effecting the other variables r and S. The blade is approximately 3 times the length of the tip section length as best shown in FIG. 3. The length of the blade can be varied to adjust the radial distance of the tip section from the central hub axis, however with a pronounced effect on the inertia of the device. The included angle between the blade and the tip section can be varied to adjust the projected vertical planform area of the tip sections (S) with minimal effect on the inertia of the device. The boomerang can be suitably formed from a uniform density polyethelyne plastic material.

As stated above, the tips decrease the magnitude of the downwash field emanating from the trailing edges of their respective blades by retarding vortical flow formation on the outboard portion of the blades. As the boomerang rotates and each successive blade progresses through the wake produced by the downwash field of the preceding blade, the average angle of attack, and thus the lift experienced by the blade, is not reduced a sufficient degree to cause an appreciable lift loss on the aft half of the boomerang, thereby limiting the tendency of the boomerang to abruptly pitch-up in an unstable manner. However, the downwash field of the tipless blade is not so altered, and thus tipless blade 34 promotes a gradual pitchup of the device. This pitch up causes the boomerang 20 to climb higher than a device with tips on all blades. This increased climb has two benefits: First, the increased climb of the boomerang stores more potential energy in the device so that the boomerang has more energy available for its return and is therefore capable of returning the full length of the inbound flight path to the thrower. Second, the increased climb of the boomerang decreases the horizontal outbound range of the boomerang allowing it to be used in smaller spaces and ensuring that it will have sufficient energy to return to the thrower. The tipless blade also provides a convenient place to grasp and throw the boomerang. The tipless blade 34 is preferably provided with a weight on its outboard-most portion to ensure that the center of the mass distribution of the device is located at the center of the boomerang, thus ensuring dynamic rotational balancing about the central hub axis.

Figure 4:
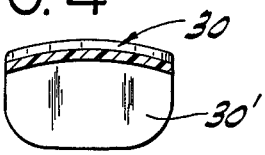
FIG. 4 is a transverse cross-sectional view of one of the blades, taken along the plane of lie 4—4 in FIG. 1.

As shown in FIG. 4, each blade is preferably cambered, with a convex upper surface and a concave bottom surface. The degree of camber (the ratio between the maximum mean line ordinate and the chord length of the blade) is preferably between 4% and 6%. The camber of the blades provides additional induction lift so that the boomerang 20 can hover when the plane of the central hub is coplanar with a horizontal reference plane and the translational velocity is near zero upon return to the thrower. This hovering capability makes the boomerang easier to catch because it gives the thrower more time to spot the boomerang and reposition, if necessary, to catch it. The camber of the blades also augments the flipping action of the boomerang on its outward bound ascent path. As described above regarding the net rolling moment applied to the device, the lift generated by the advancing side blades is augmented by the camber effect which in turn aids in the flipping action. The camber is preferably symmetrical in transverse cross-section about the longitudinal centerline of the blades. This symmetry allows the boomerang to be operated successfully by both the left and right handed throwers.

The dihedral angle between the plane of the hub and the plane of each blade is preferably between about 160 and 180 degrees. Dihedral angles of less than 180 degrees slow the flipping action of the boomerang 20 on the outbound flight path and also increase the lateral and directional stability of the boomerang 20 when it is upright, reducing its tendency to continue flipping after it has righted itself.

OPERATION

The boomerang 20 is grasped at the end of the tipless blade 34, and thrown in such a manner to impart both rotation motion about its central axis and translational motion generally forward and upward. For a right handed thrower: The boomerang may be thrown underhanded in which case it would be thrown in a generally vertical plane, with the bottom facing away from the thrower. The thrower thus imparts a clockwise rotation to the boomerang (as viewed from the top). In flight the boomerang will flip clockwise 90° (as viewed from behind the the thrower) until it is right side up. The boomerang may also be thrown overhanded in which case it would be thrown in a generally vertical plane with the bottom facing toward the thrower. The thrower thus imparts a clockwise rotation to the boomerang (as viewed from the top). In flight the boomerang will flip clockwise 270° (as viewed from behind by the thrower) until it is right side up. The boomerang may also be thrown side arm in which case it would be thrown in a generally horizontal plane with the bottom facing up. The thrower thus imparts a clockwise rotation to the boomerang (as viewed from the top). In flight the boomerang will flip clockwise 180° (as viewed from behind by the thrower) until it is right side up.

As the boomerang 20 traverses the outbound ascent flight path generally in a single vertical plane, the cambered blades together with the tip sections give the boomerang additional lift on the advancing side relative to the retreating side generating a net rolling moment about the longitudinal line of travel causing the boomerang 20 to flip over. For example, as shown in FIG. 5, if boomerang 20 were rotating in direction R while traveling in direction T, the relative airspeed of the air over the advancing blades and thus the lift, would be greater on the advancing blades of the right side than the retreating blades of the left side. However, because the boomerang 20 is upside-down, the additional lift on the right side is actually in the downward direction, so that the right side would drop and the left side would rise, causing the boomerang to flip in the clockwise direction as viewed from behind the thrower. After the flipping sequence is accomplished, the tipless blade causes the boomerang to progressively pitch upward increasing the angle of the climb, causing the boomerang 20 to gain appreciable altitude and potential energy. The pitching up motion facilitated by the tipless blade continues until the angle of attack of maximum lift is achieved and the blades and tips stall, bringing the translational velocity of the boomerang 20 to zero.

The dihedral angle of the boomerang tends to stabilize the boomerang and prohibit further flipping once the boomerang rights itself and climbs to its maximum apex. On the return leg of the journey, the boomerang descends along a downward arcing path in generally a blade level attitude with the tips pointing towards the ground. During about the last quarter of the return leg, the boomerang again tends to pitch up gradually, although not as severe as during the outbound path. This gradual pitchup increases the drag acting on the boomerang and tends to slow the return velocity. Furthermore, the gradual pitchup caused primarily by the tipless blade facilitates the transition of the boomerang to the hovering mode. Once in the hovering mode at near zero translational velocity, the boomerang 20 descends generally vertically to the thrower. Because of the higher climb and shorter range compared to prior boomerangs, the boomerang has more available potential energy to convert into translational velocity to return closer to the thrower. While the thrower may have to reposition somewhat, the slower airspeed and the tendency of the boomerang 20 to hover gives the thrower more time to spot the boomerang and reposition as necessary to catch it. The boomerang 20 is easily caught by poking one's finger or a stick through the opening in the central hub region.

In view of the above, it will be seen that the several objects of the invention are achieved and other advantageous results attained. The device is easily fabricated from a wide range of materials. With a reasonably little amount of practice, the device can be made to perform in the manner described primarily for amusement purposes.

As various changes could be made in the above constructions without departing from the scope of the invention, it is intended that all matter contained in the above description or shown in the accompanying drawings shall be interpreted as illustrative and not in a limiting sense.

What is claimed is:

1. A boomerang comprising:

a central hub;

a plurality of blades extending generally radially outwardly from the hub;

a tip depending generally downwardly from each of the blades but one, the included angle between each tip and its respective blade being greater than 90°.

2. The boomerang according to claim 1 wherein the width of each tip tapers from the end of the blade to the end of the tip.

3. The boomerang according to claim 1 wherein the included angle between each successive tip and its respective blade increases in either the clockwise or counterclockwise direction around the boomerang.

4. The boomerang according to claim 1 wherein the blade without a tip is weighted.

5. The boomerang according to claim 1 wherein the hub has a generally centrally located aperture therein.

6. The boomerang according to claim 1 wherein the blades are cambered.

7. The boomerang according to claim 6 wherein the blades are symmetric in transverse cross-section about a longitudinal centerline.

8. The boomerang according to claim 1 wherein the dihedral angle between the top of the hub and the top of each wing is between about 180° and about 167.5°.

9. The boomerang according to claim 1 wherein the blades are equally spaced from each other.

10. A boomerang comprising:

a central hub having a generally central aperture therein;

a plurality of equally spaced cambered blades extending generally radially outwardly from the hub;

a tip depending generally downwardly from each of the blades but one, the included angle between each blade and its respective tip being greater than 90°, the width of the tip tapering toward the end of the tip; and means for weighting the blade without a tip.

11. The boomerang according to claim 10 wherein the included angle between each successive tip and its respective blade increases in either the clockwise or counterclockwise direction around the boomerang.

12. The boomerang according to claim 10 wherein the blades are symmetric in transverse cross-section about the longitudinal centerline of the blade.

13. The boomerang according to claim 10 wherein the dihedral angle between the top of the hub and the top of each wing is between about 180° and about 167.5°.

14. The boomerang according to claim 10 wherein there are at least three blades.

15. The boomerang of according to claim 14 wherein there are five blades.

16. A boomerang comprising:

a central hub having a generally central aperture therein;

at least three equally spaced cambered blades extending generally radially outwardly from the hub, each of the blades being symmetric in transverse cross section about the longitudinal centerline of the blade, the dihedral angle between the top of the hub and the top of each blade being less than 180°;

a tip depending generally downwardly from each of the blades but one, the included angle between each blade and its respective tip being greater than 90°, the width of the tip tapering toward the end of the tip;

means for weighting the blade without a tip so that the boomerang is mass balanced about an axis through the center of the hub.

17. The boomerang according to claim 16 wherein the included angle between each successive tip and its respective blade increases in either the clockwise or counterclockwise direction around the boomerang.

18. The boomerang of according to claim 16 wherein there are five blades.

* * * * *